US006794970B2

(12) United States Patent
Reis et al.

(10) Patent No.: US 6,794,970 B2
(45) Date of Patent: Sep. 21, 2004

(54) LOW ALTERNATING CURRENT (AC) LOSS SUPERCONDUCTING COILS

(75) Inventors: Chandra T. Reis, Altamont, NY (US); Michael S. Walker, Albany, NY (US)

(73) Assignee: IGC-Super Power, LLC, Schenectady, NY (US)

( * ) Notice: Subject to any disclaimer, the term of this patent is extended or adjusted under 35 U.S.C. 154(b) by 0 days.

(21) Appl. No.: 10/381,125

(22) PCT Filed: Sep. 26, 2001

(86) PCT No.: PCT/US01/30086

§ 371 (c)(1),
(2), (4) Date: May 22, 2003

(87) PCT Pub. No.: WO02/27736

PCT Pub. Date: Apr. 4, 2002

(65) Prior Publication Data

US 2003/0178653 A1 Sep. 25, 2003

Related U.S. Application Data

(60) Provisional application No. 60/235,733, filed on Sep. 27, 2000, and provisional application No. 60/241,592, filed on Oct. 19, 2000.

(51) Int. Cl.[7] ..... H01F 7/00

(52) U.S. Cl. ..... 335/216; 174/125.1

(58) Field of Search ..... 335/216; 174/125.1

(56) References Cited

U.S. PATENT DOCUMENTS

| | | | | |
|---|---|---|---|---|
| 4,921,041 A | * | 5/1990 | Akachi | 165/104.29 |
| 5,912,607 A | | 6/1999 | Kalsi et al. | |
| 5,914,647 A | | 6/1999 | Aized et al. | |
| 6,066,906 A | | 5/2000 | Kalsi et al. | |
| 6,081,987 A | | 7/2000 | Kalsi et al. | |
| 6,617,714 B2 | * | 9/2003 | Laskaris | 310/54 |

FOREIGN PATENT DOCUMENTS

| | | | | |
|---|---|---|---|---|
| JP | 62133049 A | * | 6/1987 | C22F/1/00 |
| JP | 2003526175 W | * | 9/2003 | H01B/12/02 |

* cited by examiner

*Primary Examiner*—Lincoln Donovan
*Assistant Examiner*—Bernard Rojas
(74) *Attorney, Agent, or Firm*—Katten Muchin Zavis Rosenman

(57) ABSTRACT

The present invention relates to high-temperature low alternating current (AC) loss superconducting coil (110A–C), to methods of fabricating such superconducting coils (110A–C) and to devices which utilize high temperature superconductor [HTS] tape coils such as transformer, motors, generators, etc.

18 Claims, 4 Drawing Sheets

LOW ALTERNATING CURRENT (AC) LOSS SUPERCONDUCTING COILS

This application claims the benefit of Provisional Application Nos. 60/235,733, filed Sep. 27, 2000 and 60/241,592, filed Oct. 19, 2000.

FIELD OF THE INVENTION

The present invention relates to low alternating current (AC) loss high temperature superconducting coils, to methods of fabricating such superconducting coils and to devices which utilize high temperature superconductor [HTS] tape coils such as transformers, motors, generators, etc.

BACKGROUND OF THE INVENTION

Electrical conductors, such as copper wires, form the basic building block of the world's electric power system, i.e., wire in transformers, electric motors, generators, and alternators. The discovery of high-temperature superconducting compounds in 1986 has led to the development of their use in the power industry. This is the most fundamental advancement in conductor technology used for power systems in more than a century.

Over the past three decades, electric power use has risen about 25%–40% in the United States. With this rising demand for power comes an increased requirement for low-cost power. Because of the lack of DC resistance and the low AC losses of superconductors at operating temperatures, superconducting devices are being developed for application throughout the electric power industry.

The power industry's future use of superconductors depends on the overall cost and performance (low power loss) benefits that the superconductor wires offer. HTS tape technologies drive down the costs, increase the current-carrying capacity, and improve the reliability of the wiring system, thus impacting electric power systems in a variety of ways. These ways include the possibility of greatly reduced size and weight of the wires used in devices such as transformers, motors, and generators. Superconductor wires have many applications because of their efficiency for carrying electricity and their ability to carry much higher electrical currents than other conducting materials in less volume.

There exists the unmet technical challenge in the power industry of fabricating HTS coils and devices in such a way that they operate with negligible alternating current (AC) losses. These superconductors can carry direct current (DC) with negligible losses, but DC is rarely used in the power industry. AC is the dominant form in most of the world's power coil-based devices. AC applications of HTS tapes operate with non-negligible energy losses, the energy escaping in the form of heat. This impacts the efficiency of the system beyond the mere energy loss since the heat generated must be removed from the environment of the device.

Superconductors operate in the temperature range of 4°–85° K, far below ambient temperature (298° K). Thus, superconductors require refrigeration, and refrigeration requires continuous expenditure of energy. For example, if the heat caused by the electrical current flowing in superconductor wires is at 77° K and is dissipated at the rate of one watt, then refrigerators must be supplied with approximately 10–40 watts of electrical power to dissipate that generated heat. Absent this refrigeration, the superconductor material would warm itself to above its sukerconducting temperature and cease to operate as a superconductor, thereby eliminating any advantage and, in particular, providing worse performance than conventional copper conductors.

The heat generated must be eliminated to cost-effectively maintain the low temperatures required by the superconductor. Successful solution of this problem would reduce operating costs by reducing the added cooling energy needed.

The key problem of HTS tapes is that unwanted AC magnetic fields are generated by the current flowing in the neighboring HTS tapes, which causes AC losses. Because the HTS tape material and geometry is anisotropic, magnetic fields passing perpendicular to the preferred direction generate significantly greater losses than those of parallel fields. In the present invention, there are no perpendicular magnetic fields except for the very ends of the wiring structures, where different loss mechanisms apply. A discussion of AC losses caused by magnetic fields can be found in W. T. Norris, J. Phys. D 3 (1970) 489–507, or Superconducting Magnets by Martin N. Wilson, Oxford University Press, Oxford, UK 1983.

Kalsi et al., U.S. Pat. No. 6,081,987, entitled "Method of Making Fault Current Limiting Superconducting Coil," provides a multiple tape HTS system. Kalsi et al. describes a superconducting magnetic coil that includes a first superconductor formed of a first anisotropic superconducting material wire for providing a low-loss magnetic field characteristic for magnetic fields parallel to the longitudinal axis of the coil, and a second superconductor material wire having a low-loss magnetic field characteristic for magnetic fields, perpendicular to the longitudinal axis of the coil. The first superconductor has a normal state resistivity characteristic conducive for providing current limiting in the event that the second superconductivity wiring material of the magnetic coil is subjected to a current fault.

Kalsi et al. wires two superconductive HTS wiring tapes in parallel along the length (longitudinally) of the cable, but the two HTS wiring tapes are of different materials and one HTS wiring tape is used as a back up for fault tolerance. There is no mention of wiring configurations to reduce AC losses.

It would be highly beneficial to develop a superconductor configuration that reduces AC losses and associated very high refrigeration costs. Practical devices for AC applications could then be wound using wide flat superconductors, the most prevalent and desirable form of high temperature superconductors (HTS).

Thus, it is an object of this invention to provide a method of fabricating superconductor coils such that AC losses due to the presence of a localized perpendicular component of the self-field is eliminated or minimized.

It is another object of this invention to provide superconducting coils with minimized AC losses due to the presence of a localized self-field perpendicular field component.

It is yet another object of this invention to provide superconducting devices with minimized self-generated AC losses.

It is yet another object to reduce refrigeration requirements associated with the operation of a HTS tapes used in wiring coil-based devices by reducing the heat generated by perpendicular magnetic fields impinging on neighboring HTS tapes.

It is yet another object of this invention to use conventional HTS wiring tapes and conventional wiring methods in a new wiring configuration to create a low cost superconducting device.

BRIEF SUMMARY OF THE PRESENT INVENTION

HTS tapes may be wound around coil structures in various ways described as "winding configurations". Winding configurations can be changed in a variety of ways by changing (1) the size of the superconductor wires (width, thickness, shape) on the coil structure, (2) the type of superconductor material used, and (3) the way the tape is wound on a coil structure itself (spacing to its neighboring wire).

Surprisingly, it has been determined that eliminating the gaps normally present when superconductor tapes are wound into coils prevents significant energy losses and limits the need for cooling of the superconductor. The present invention obtains low AC loss results by providing novel techniques of winding the tape on a coil stricture.

In most applications, the HTS tape is continuously in the presence of an AC field. The present invention is directed toward HTS tape-winding configurations used in applications where the AC frequency is typically in the range of 50–60 Hz (normal operating frequency in the power industry). By using HTS tapes instead of standard copper wires, better performance (lower power losses) and lower cost are achieved. However, HTS tapes require cooling, which uses power. The present invention is directed to HTS tape wiring configurations designed to achieve low AC losses, thereby reducing refrigeration requirements and enabling superconducting wiring structures to achieve their higher performance at lower cost.

A significant source of AC loss is the loss caused by the magnetic fields of the neighboring HTS tapes, said field being generated by AC current traveling through HTS tapes. In particular, the magnetic self-fields that are allowed to form because of gaps between the HTS tapes.

It has now been discovered the superconductors composed of conventional materials but wound in specified configurations eliminate certain energy losses commonly present in HTS applications. The invention applies broadly to a superconductor winding configuration that eliminates local perpendicular field components.

This new HTS tape configuration approximates a single current "sheet", which produces minimal magnetic fields perpendicular to the current flow, thus significantly reducing AC losses.

The invention comprises a method of fabricating superconductor coils that minimize the AC losses in the main body of the superconducting coil and low AC loss superconducting coils. The beneficial results of the invention are obtained by fabricating superconducting coils such that superconductors overlap one another so that gaps between the superconductors are covered by another superconductor.

Because there are no uncovered gaps, the individual turns of the HTS tapes approximate a single long former of current, forcing the magnetic field to be primarily parallel to the surface of the former and surface of the superconductor. This is a preferential orientation because it minimizes or eliminates the component of the magnetic field perpendicular to the surface of the superconductor. With no substantial perpendicular field component, the high perpendicular field losses in the superconductor are eliminated.

DETAILED DESCRIPTION OF THIS INVENTION

The present invention relates to superconductor tapes, fabrication methods and configurations that are designed to minimize the AC losses in a superconducting device or assembly. Superconducting tapes of various compositions are well known. Suitable high-temperature superconductor tapes are for example Bi-2223 superconducting tapes, and include, but are not limited to, those superconductor tapes that are formed from any of the following families of superconductive materials: cuprates (such as YBCO or BSCCO), diborides, or metallic superconductors.

Suitable HTS tapes can be flat and can also be elliptical, or rectangular. HTS tapes are typically from about 0.001 mm to about 10 mm thick and from about 0.5 mm to as wide as convenient for the design of the superconducting assembly. The HTS tapes can be either monocore or multifilament, thin or thick film, powder-in-tube or surface-coated, or any variety of high-temperature superconductors where the final form is flat, elliptical, or rectangular.

A single layer of HTS tape may be used in the lapped embodiment of the invention; a minimum of two HTS layers are required to achieve the benefits of the invention in other embodiments, but it is possible to have as many layers as are required by design considerations.

The HTS tapes are wound on a "former," which is used to support the HTS tapes. The former may be cylindrical, rectangular, or other shape. This former structure can range from 1 inch to several yards in diameter and can range from several inches to several yards in length. HTS tapes are preferably wound very nearly perpendicular to the longitudinal axis of the total former structure to create a coil and to maximize its effectiveness electrically and physically. HTS tapes can also be wound at different angles relative to the longitudinal axis of the former structure to create a coil with different electrical and physical requirements. The tapes are wound on the former using conventional fabrication techniques. Any conventional former can be utilized in the process; upon completion of tape wrapping the former may remain or may be removed.

These tapes are configured so that they overlap one another such that all gaps between HTS tapes are covered by another HTS tape. The HTS tapes are essentially parallel conductors terminated together at the ends of the superconducting device FIGS. 1 and 2 illustrate, in very general terms, how prior art high-temperature superconductor wires or HTS tapes in the presence of magnetic fields create AC losses in prior art devices.

Figure 1:
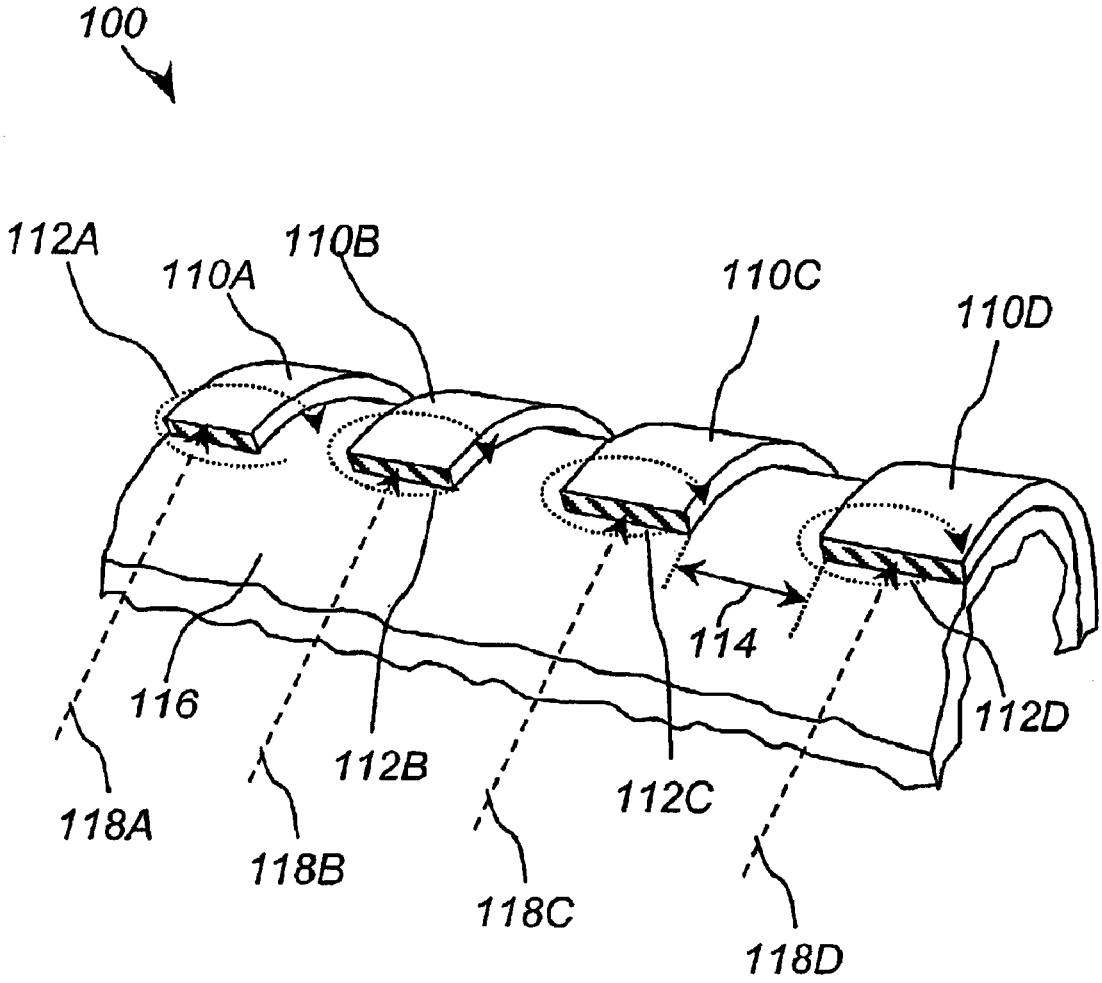
FIG. 1 is a sectional view of a typical prior art device illustrating the general effects of magnetic self field of one HTS tape on a neighboring HTS tape.

FIG. 1 shows an example of a general view 100 of prior art HTS tapes on a former. The former 116, supports the HTS tapes. A cutaway portion of four HTS tapes 110A–D is also shown. HTS tapes 110 A–D can be either separate tapes, different cross-sections of the same tape, or a combination thereof. The former 116, shown in FIG. 1, is a small section of a cylindrical, rectangular, elliptical or other shape of a total former structure that HTS tapes 110A–D are wound around. HTS tapes 110A–D are shown wound very nearly perpendicular to the longitudinal axis of the total former structure but can also be wound at different angles relative to the longitudinal axis of the total former 116 structure.

The electrical current direction flowing in each HTS tape 110A–D is shown as 118A–D, respectively. Current 118A flowing in HTS tape 110A shows the direction of a magnetic self-field loop 112A. Magnetic field loops 112B, 112C, and 112D are also shown for currents 118B, 118C, and 118D, respectively. Also shown in FIG. 1 is a gap 114 between HTS tapes 110C and 110D. Note that this gap 114 exists between HTS tapes 110A and 110B and between HTS tapes 110B and 110C as well, but is not annotated. Because gaps 114 exist, the magnetic self-fields are able to complete their magnetic loops. Although FIG. 1 portrays magnetic self-field loops 112A–D as single discrete loops, it should be noted that the magnetic field is infinitely continuous, although the field strength diminishes as one moves away from HTS tape 110A–D.

Figure 2:
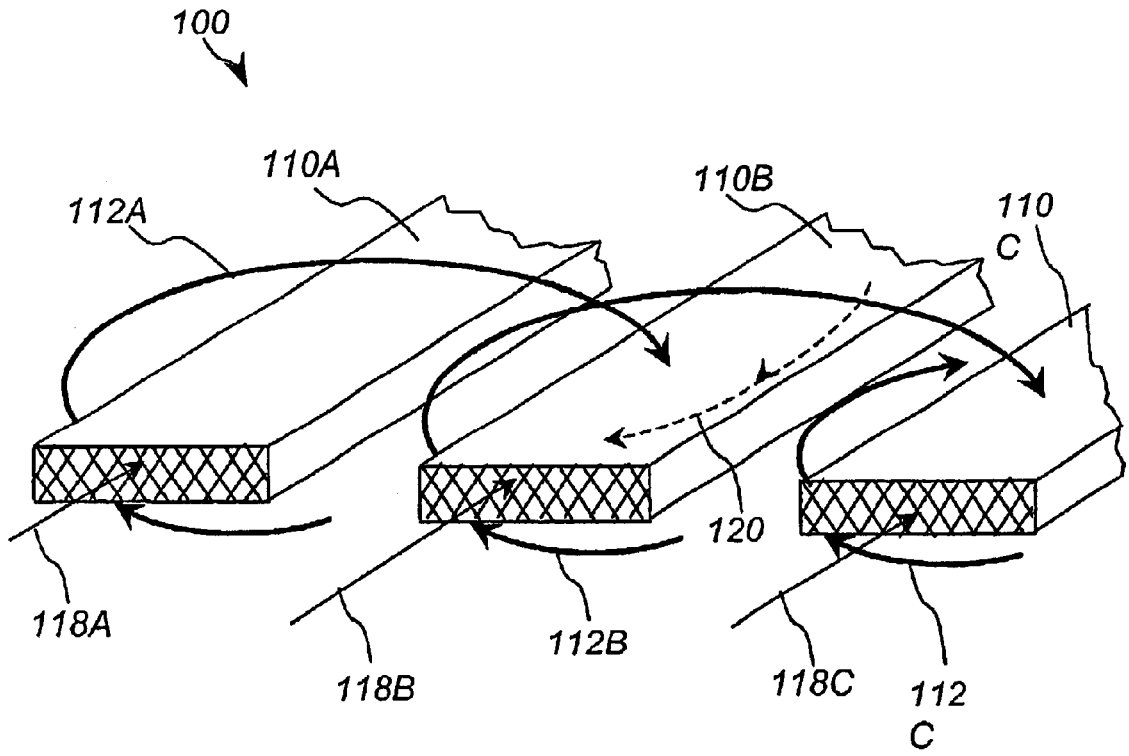
FIG. 2 is a magnified view of a typical prior art device illustrating the general effects of magnetic self field of one HTS tape on a neighboring HTS tape.

FIG. 2 shows a more detailed view of FIG. 1 with further detail regarding magnetic fields in prior art devices. The detail view shows three separate HTS tapes 110A–C. The electrical current direction flowing in each HTS tape 110A–C is shown as 118A–C, respectively. AC current 118A flowing in HTS tape 110A shows the direction of AC magnetic self-field loop 112A. AC magnetic self-field loop 112B for current 118B is also shown. AC magnetic self-field loop 112A is shown to impinge HTS tape 110B. This impinging of field lines on HTS tape 110B can range from angles that are perpendicular to the surface of HTS tape 110B to angles that are parallel to HTS tape 110B.

The impinging of perpendicular component of the AC magnetic self-field 112A on HTS tape 110B, when it is near perpendicular to HTS tape 110B, induces a deleterious current flow 120 in HTS tape 110B that creates AC loss. For further discussion, see W. T. Norris, J. Phys. D 3 (1970) 489–507, or Superconducting Magnets by Martin N. Wilson, Oxford University Press, Oxford, UK 1983. Also shown is how each HTS tape 110, like HTS tape 110B with current 118B, has its magnetic self-field 112B, which impinges on its nearest neighbor HTS tape 110C.

Decreasing or eliminating the perpendicular component of the magnetic field that is created by the local magnetic self-field 112A, as shown in FIG. 1, substantially reduces AC losses. HTS tapes are anisotropic and therefore much higher losses are induced from peipendicular magnetic fields than from parallel magnetic fields. Present winding techniques allow for winding of an HTS tape into superconducting coils and devices in a manner that causes gaps to form between the HTS tapes. As current flows through the HTS tapes, these gaps allow perpendicular magnetic fields to form around the HTS tapes, and these field lines penetrate into adjacent HTS tapes, and thus create AC losses.

Figure 3:
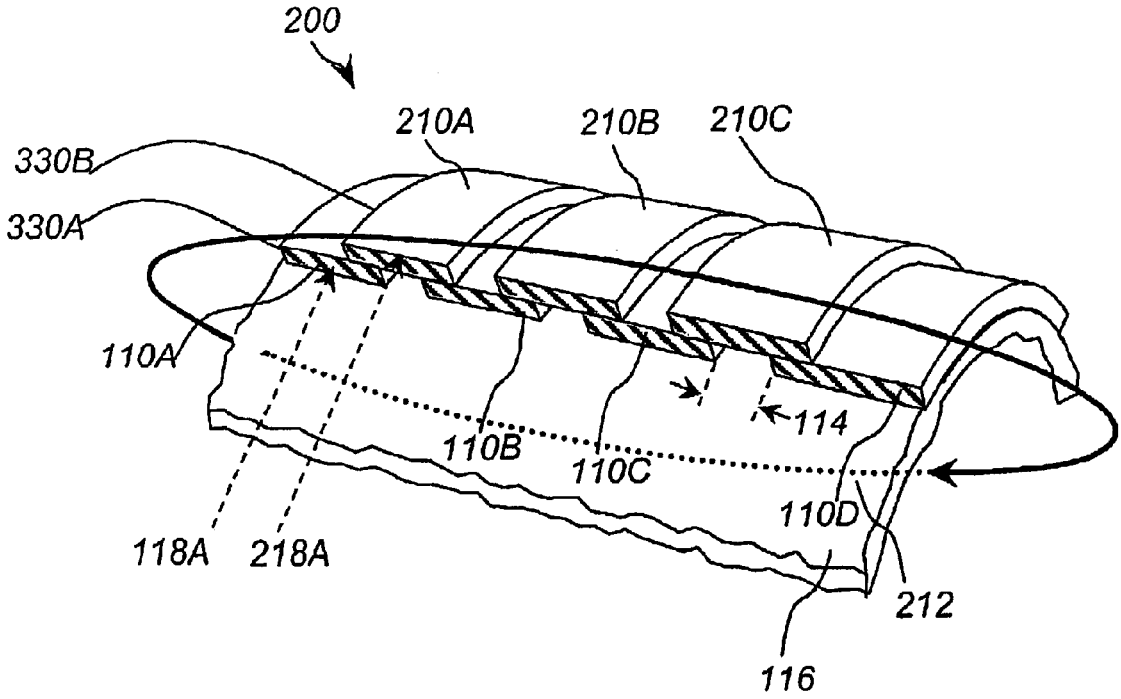
FIG. 3 is a sectional view of a typical inventive device illustrating a staggered winding configuration in a HTS tape wire assembly of the present invention.

The HTS tapes 110A–D and HTS tapes 210A–C, represented in FIG. 3, depicting an inventive device, are individual high-temperature superconductor tapes. In the figure, HTS tapes 110A–D and 210A–C are shown as flat, but suitable HTS tapes can also be elliptical, or rectangular. In FIG. 3, only two layers are shown, first HTS tape level 330A and second HTS tape layer 330B, but it is possible to have as many layers as are required by design considerations.

Above a given magnitude of current, called the "critical current" flowing in the superconductor, the superconductor will go normal, that is, no longer be superconducting. For currents at or less than the critical current of the superconducting material, this staggered configuration approximates a single-turn current sheet, forcing the collective fields to be mainly parallel to the surface of the superconductor winding, a preferential orientation. Therefore, with no substantial perpendicular field component, the high AC losses caused by perpendicular magnetic fields penetrating adjacent HTS tapes are eliminated in the main body of the superconducting assembly.

When transport currents are at, or less than the critical current of the superconductor, this approximates a single-turn current sheet with a constant transport current per unit of axial length along the coil, a situation that substantially minimizes the perpendicular field (with the exception of the end-trim regions). The collective magnetic field loop 212 of FIG. 3 surrounding the approximated single-turn current sheet is almost completely parallel to the surface of the HTS tapes in the main body of the windings.

A first preferred embodiment of the invention is the staggered winding embodiment. The staggered winding embodiment of the invention is described more clearly with reference to FIG. 3 which shows a cutaway section of staggered winding configuration 200 for a first embodiment of the present invention. FIG. 3 shows HTS tapes 110A–D on former 116. HTS tapes 110A–D are separated by spaces or gaps 114 (one is shown for demonstration purposes). HTS tapes 110A–D are shown on a first HTS tape layer 330A. A plurality of HTS tapes 210A–210C of a second HTS tape layer 330B are shown arranged on top of first HTS tape layer 330A. Each HTS tape 210 of second HTS tape level 330B overlaps gaps 114 in first HTS tape layer 330A. For instance, HTS tape 210C covers gap 114 between HTS tape 110C and HTS tape 110D. Current 118A shows the direction of current flow in HTS tape 110A of first HTS tape layer 330A, whereas a current 218A shows the direction of current flow in HTS tape 210A of second HTS tape layer 330B. All current flows in identical directions in all HTS tapes at both first HTS tape layer 330A and second HTS tape layer 330B. A magnetic field loop 212 is created by the composite of the current flow shown in current flow directions 118A and 218A in all HTS tapes 110A–D and all HTS tapes 210A–C, respectively. Note that magnetic field loop 212 is parallel to all HTS tapes 110A–D and HTS tapes 210A–C.

In a second preferred embodiment, as is more clearly described by reference to FIG. 4, a lapped winding configuration 300 is used. Winding an HTS tape such that one edge of the HTS tape rests on the surface of a former and the opposite edge rests on an adjacent HTS tape creates the lapped configuration.

Figure 4:
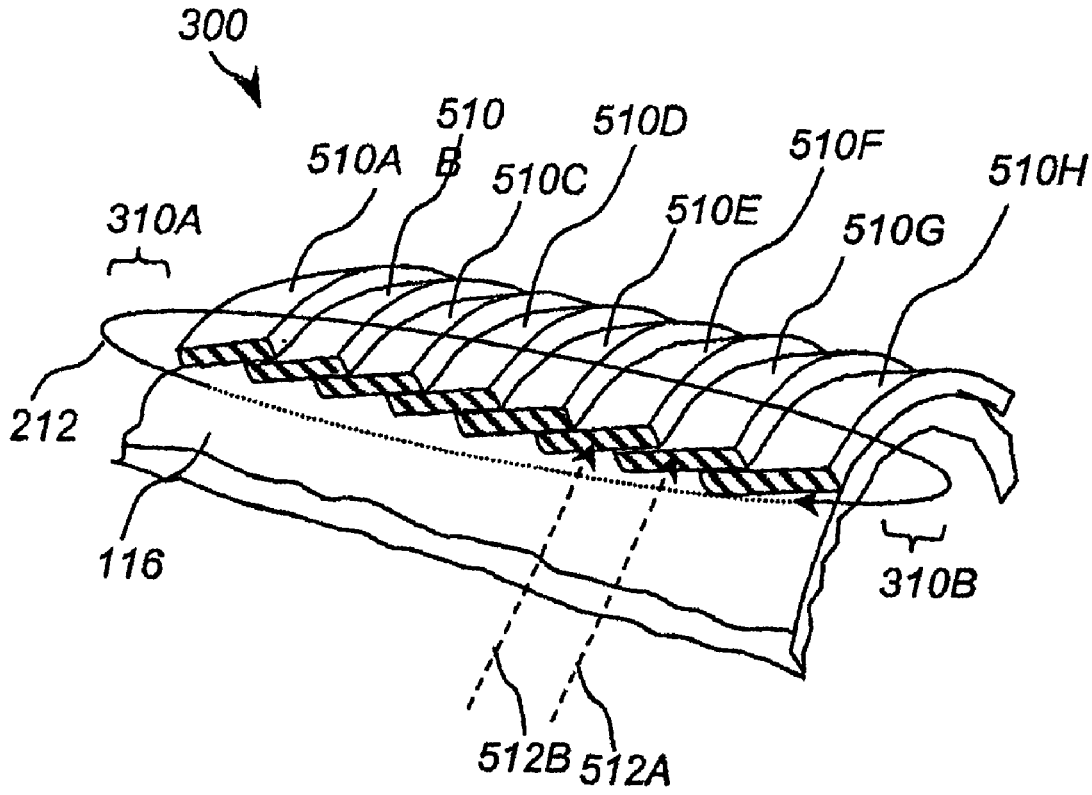
FIG. 4 is a sectional view of a typical inventive device illustrating a lapped winding configuration in a HTS tape wiring assembly of the present invention.

As shown in FIG. 4, a plurality of HTS tapes 510A–H are wound on former 116. A current direction 512A and a current direction 512B show the direction of current in HTS tapes 510G and 510F, respectively. Not shown are all the other current flow lines, which are all in the same direction as current directions 512A and 512B. The magnetic field loop 212, caused by the composite current flow in HTS tapes 510A–H, runs mostly parallel to HTS tapes 510A–H. An end region 310A and an end region 310B show magnetic field loop 212 being completed at the outer regions of the superconductor assembly. As described above, there is some perpendicular component of magnetic field loop 212 in some end winding HTS tapes 512A and 512H, which may cause AC losses. However, in this lapped winding configuration 300 there is virtually no perpendicular component to magnetic self-field 212 for HTS tapes not at the ends, and therefore minimal AC losses.

The winding sections of HTS tapes 510A–H, in the present embodiment, are winding sections of an individual, high-temperature superconductor tape, but could be any number of tapes in parallel. HTS tapes 510A–H are shown flat, but may be made elliptical or rectangular. HTS tapes 510A–H are preferably wound around former 116 in a nearly perpendicular path relative to the longitudinal axis of former 116.

What is claimed is:

1. A low alternating current loss superconducting coil comprising a plurality of superconductor tapes, a portion of such tapes being individually positioned in a first layer around a longitudinal axis and extending longitudinally with such axis, gaps being present between the superconductive material in adjacent tapes of such first layer, and at least one second layer formed of a portion of such plurality of tapes each individually positioned in a second layer around a longitudinal axis and extending longitudinally with such axis, gaps being present between superconductive material in adjacent tapes of the at least one second layer, the superconductive material of the at least one second layer overlapping the gaps in the first layer.

2. A low alternating current loss superconducting coil as in claim 1, wherein the first layer and at least one second layers are mostly circular in cross section and concentric, the at least one second layer having superconductive material that collectively entirely overlaps the gaps in said first layer.

3. A superconducting coil as in claim 2, wherein the tapes are at least flat in cross section.

4. A low alternating current loss superconducting coil, comprising a plurality of superconductor tapes, each tape being individually positioned in a first layer around a longitudinal axis and extending longitudinally with said axis, each tape in being located between two immediately adjacent tapes, one lateral edge of each tape underlapping one associated adjacent tape and the other lateral edge of each said tape overlapping the other associated adjacent tape, such that at least a minor portion of the superconductive part of the superconductor tape under or overlaps an associated adjacent tape.

5. A superconducting coil as in claim 4, wherein said lapped tapes provide a continuous circumferential loop of superconducting material around said axis.

6. A low alternating current loss producing superconductor coil comprising HTS superconducting tape wrapped in a gap free lapped configuration on an annular substrate.

7. A method of preparing a low alternating current loss superconducting coil comprising wrapping a cylindrical former section with at least one superconductor, such superconductor being positioned around the longitudinal axis of such former such that at least 1% of each winding of such superconductor around such former overlaps an associated adjacent winding.

8. The method of claim 7 wherein the superconductor overlaps at least 75%.

9. A method of fabricating low current loss superconducting coils comprising winding a coil of superconducting tape around a former, where the superconducting coil comprises a plurality of superconductor tapes, individually positioning each tape in a first layer around a longitudinal axis and extending longitudinally with said axis, locating each tape between two immediately adjacent tapes, one lateral edge of each tape underlapping one associated adjacent tape and the other lateral edge of each said tape overlapping the other associated adjacent tape, such that at least a minor portion of the superconductive part of the superconductor tape under or overlaps an associated adjacent tape.

10. An alternate current handling electrical device containing a low alternating current loss superconducting coil, such coil comprising a plurality of superconductor tapes, each tape being individually positioned in a first layer around a longitudinal axis and extending longitudinally with said axis, each tape in being located between two immediately adjacent tapes, one lateral edge of each tape underlapping one associated adjacent tape and the other lateral edge of each said tape overlapping the other associated adjacent tape, such that at least a minor portion of the superconductive part of the superconductor tape under or overlaps an associated adjacent tape.

11. The device of claim 10 that is selected from the group consisting of transformers, fault current limiters, electric motors, generators, and alternators.

12. An alternate current handling electrical device containing a low alternating current loss superconducting coil, such coil comprising a plurality of superconductor tapes, a portion of such tapes being individually positioned in a first layer around a longitudinal axis and extending longitudinally with such axis, gaps being present between the superconductive material in adjacent tapes of such first layer, and at least one second layer formed of a portion of such plurality of tapes each individually positioned in a second layer around a longitudinal axis and extending longitudinally with such axis, gaps being present between superconductive material in adjacent tapes of the at least one second layer, the superconductive material of the at least one second layer overlapping the gaps in the first layer.

13. The device of claim 12 that is selected from the group consisting of transformers, fault current limiters, electric motors, generators, and alternators.

14. A low alternating current loss superconducting coil comprising a plurality of superconductor tapes, where a portion of such tapes is individually positioned in a first layer around a longitudinal axis and extending longitudinally with such axis, gaps being present between the superconductive material in adjacent tapes of such first layer, and at least one second layer is formed of a portion of such plurality of tapes each individually positioned in a second layer around a longitudinal axis and extending longitudinally with such axis, gaps being present between superconductive material in adjacent tapes of the at least one second layer, the superconductive material of the at least one second layer overlapping the gaps in the first layer, or each tape is individually positioned in a first layer around a longitudinal axis and extending longitudinally with said axis, each tape being located between two immediately adjacent tapes, one lateral edge of each tape underlapping one associated adjacent tape and the other lateral edge of each said tape overlapping the other associated adjacent tape, such that at least a minor portion of the superconductive part of the superconductor tape under or overlaps an associated adjacent tape.

15. The coil of claim 14 wherein the superconducting tape is selected from a member of the group consisting of cuprate based, diboride based and metallic superconducting tapes.

16. The coil of claim 14 wherein the superconducting tape is a tape selected from the group consisting of monocore, multifilament, thin film, thick film, powder-in-tube and surface-coated superconducting tapes.

17. The coil of claim 14 wherein the superconducting tape is a tape selected from the group consisting of elliptical, and rectangular superconducting tapes.

18. The coil of claim 14 wherein the superconducting tape has a thickness of from about 0.001 mm to about 10 mm thick.

* * * * *

UNITED STATES PATENT AND TRADEMARK OFFICE

CERTIFICATE OF CORRECTION

PATENT NO. : 6,794,970 B2 
DATED : September 21, 2004
INVENTOR(S) : Chandra T. Reis and Michael S. Walker It is certified that error appears in the above-identified patent and that said Letters Patent is hereby corrected as shown below:

Column 1,
Line 7, insert the following:
-- This invention was made with government support under Contract No. DE-FC36-98GO10282 awarded by the Department of Energy. The government has certain rights in this invention. --

Signed and Sealed this

Fifth Day of April, 2005

JON W. DUDAS
*Director of the United States Patent and Trademark Office*